US010480745B1

(12) United States Patent
Li

(10) Patent No.: US 10,480,745 B1
(45) Date of Patent: Nov. 19, 2019

(54) ARRANGED LIGHT PIPES FOR AUTOMOTIVE LIGHTING SYSTEMS

(71) Applicant: Valeo North America, Inc., Troy, MI (US)

(72) Inventor: Ziyi Li, Seymour, IN (US)

(73) Assignee: Valeo North America, Inc., Troy, MI (US)

( * ) Notice: Subject to any disclaimer, the term of this patent is extended or adjusted under 35 U.S.C. 154(b) by 0 days.

(21) Appl. No.: 15/987,990

(22) Filed: May 24, 2018

(51) Int. Cl.

| | |
|---|---|
| ***F21S 43/237*** | (2018.01) |
| ***F21S 43/31*** | (2018.01) |
| ***F21S 41/24*** | (2018.01) |
| ***F21S 41/32*** | (2018.01) |
| *F21W 104/00* | (2018.01) |

(52) U.S. Cl.
CPC ..... *F21S 43/237* (2018.01); *F21S 41/24* (2018.01); *F21S 41/322* (2018.01); *F21S 43/315* (2018.01); *F21W 2104/00* (2018.01)

(58) Field of Classification Search
CPC ..... F21S 43/235–251; F21S 41/24; B60Q 1/0011; B60Q 3/62–66
See application file for complete search history.

(56) References Cited

U.S. PATENT DOCUMENTS

| | | | | |
|---|---|---|---|---|
| 4,811,172 | A | 3/1989 | Davenport et al. | |
| 6,286,970 | B1 * | 9/2001 | Egawa | G02B 6/0028 362/556 |
| 9,256,019 | B2 | 2/2016 | Godbillon | |
| 2003/0231485 | A1 | 12/2003 | Chien | |
| 2006/0075666 | A1 | 4/2006 | Thielemans et al. | |
| 2011/0013411 | A1 * | 1/2011 | Sakiyama | B60Q 1/2665 362/494 |
| 2012/0099310 | A1 | 4/2012 | Kropac et al. | |
| 2015/0008840 | A1 * | 1/2015 | Reinprecht | G02B 6/001 315/210 |
| 2015/0241014 | A1 * | 8/2015 | Leutiger | F21S 43/14 362/511 |

* cited by examiner

*Primary Examiner* — Sean P Gramling
(74) *Attorney, Agent, or Firm* — Oblon, McClelland, Maier & Neustadt, L.L.P.

(57) ABSTRACT

The present disclosure relates to a light pipe arrangement for complex automotive lighting features. The light pipe arrangement includes proximately aligned light pipes comprising at least one grouping of reflecting facets for creating a striped aesthetic.

20 Claims, 10 Drawing Sheets

812

ARRANGED LIGHT PIPES FOR AUTOMOTIVE LIGHTING SYSTEMS

BACKGROUND

Field of the Disclosure

The present disclosure relates to an arrangement of individual light pipes in order to provide a specific visual aesthetic in automotive lighting applications.

Description of the Related Art

In the field of automotive lighting and signaling, it is increasingly commonplace to use optical guides. In practice, optical guides, or light guides, present the advantage of being able to assume widely varied geometrical forms. Moreover, these geometrical forms and form factor make it possible to bring a lighting surface to previously inaccessible areas of a lighting and/or signaling device. This is especially relevant as users demand aesthetics and styling that are not easily produced from traditional headlamp design. Specifically, patterned aesthetics require lighting implementations that often result in lighting inefficiencies and/or reduced acuity in user perception of the aesthetic.

The foregoing "Background" description is for the purpose of generally presenting the context of the disclosure. Work of the inventors, to the extent it is described in this background section, as well as aspects of the description which may not otherwise qualify as prior art at the time of filing, are neither expressly or impliedly admitted as prior art against the present invention.

SUMMARY

The present disclosure relates to a lighting device for an automotive vehicle, comprising at least one light source, and one or more light guides optically-coupled to the at least one light source and configured to guide a light emitted from the at least one light source along a light guiding direction, wherein each of the one or more light guides extend in a pre-determined direction from the at least one light source and comprise a plurality of decoupling regions separated from each other by an inter-grouping distance along the light guiding direction of the one or more light guides.

The present disclosure further relates to a method of guiding light in a lighting device of an automotive vehicle, comprising guiding, along a light guiding direction from an input face of one of one or more light guides, a light emitted from at least one light source, reflecting, via one of a plurality of decoupling regions, the light emitted from the at least one light source, and projecting, via the one of the plurality of decoupling regions, the reflected light to an output face of the one of the one or more light guides, wherein each of the one or more light guides are optically-coupled to the at least one light source and extends in a pre-determined direction from the at least one light source, and the plurality of decoupling regions are separated from one another by an inter-grouping distance along the light guiding direction of each of the one or more light guides.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
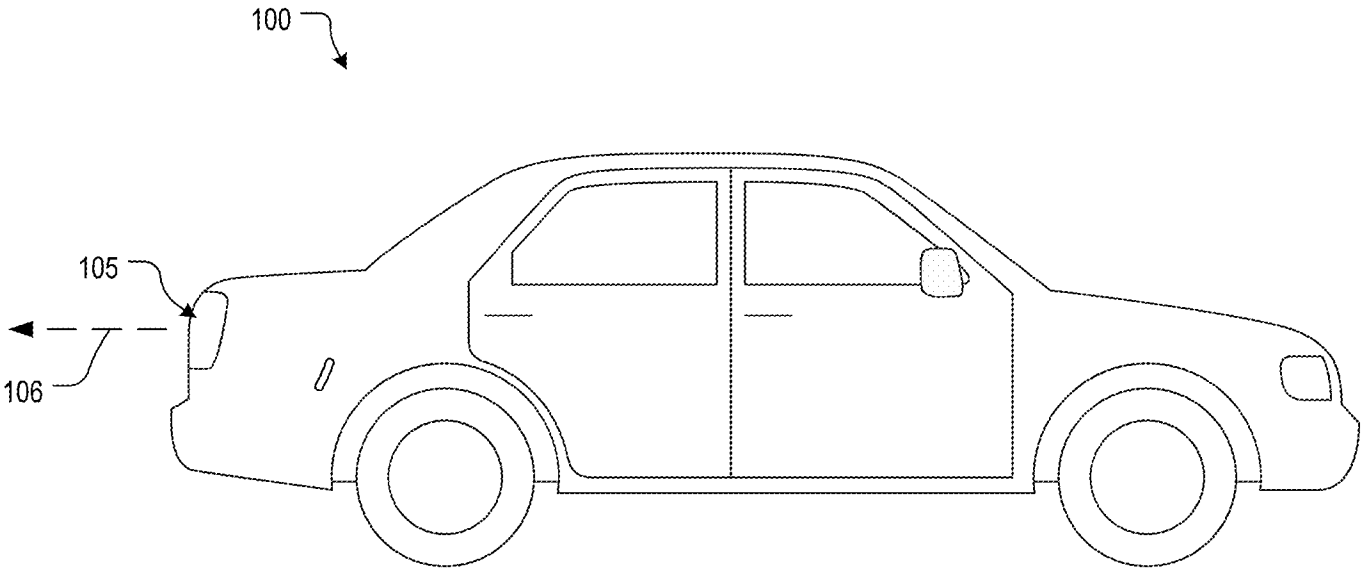
FIG. 1 is an illustration of an automotive vehicle, according to an exemplary embodiment of the present disclosure.

The terms "a" or "an", as used herein, are defined as one or more than one. The term "plurality", as used herein, is defined as two or more than two. The term "another", as used herein, is defined as at least a second or more. The terms "including" and/or "having", as used herein, are defined as comprising (i.e., open language). Reference throughout this document to "one embodiment", "certain embodiments", "an embodiment", "an implementation", "an example" or similar terms means that a particular feature, structure, or characteristic described in connection with the embodiment is included in at least one embodiment of the present disclosure. Thus, the appearances of such phrases or in various places throughout this specification are not necessarily all referring to the same embodiment. Furthermore, the particular features, structures, or characteristics may be combined in any suitable manner in one or more embodiments without limitation.

In the present disclosure, the term "optical guide" or "light guide" is used to mean a transparent or translucent component inside which light rays are propagated in a controlled manner from one of the ends of the guide, called the "input face", to at least one output face. The controlled propagation of the light rays is generally performed by internal reflections on various faces, called internal reflection faces.

As further introduction, in some light guides, the internal reflection faces may return the light toward an output face other than the terminal face, so that an observer has the impression that the output face is lit and that this output face corresponds to a light source. In certain situations, this output face may be one of the internal reflection faces. In this case, some incident rays on a first internal reflection face are returned with an angle of incidence to a second internal reflection face such that, instead of being reflected on the second internal reflection face, these rays are transmitted, or refracted, and leave the guide. These first internal reflection faces can be obtained by creating a series of prisms, or reflecting facets, on a rear face of the external surface of the guide. When a propagating light ray reaches one of the reflecting facets, or decoupling regions, a portion of the propagating light ray is reflected at an angle not along its normal, longitudinally-focused trajectory, causing it to come into contact with the second internal reflection face at an angle of incidence such that the light ray is transmitted out of the light guide. As a result, the second internal reflection face becomes an output face and appears as a light source. Said reflecting facets can be molded along a length of the light guide during light guide fabrication, making it possible to obtain the emission of a light at a distance from the true light source and with an appearance that is uniform on the output face when the light pipe is in the on state.

Recently, users have become interested in automotive lighting and/or signaling devices with advanced aesthetics. For example, it may be requested that a brake light have a striped appearance, appearing as a series of alternating red stripes and black stripes. Achieving this aesthetic, however, is complicated when designers are confined to the traditional construction of automotive lamps. That is to say, this aesthetic must be created using an adjacently-positioned light source, reflector surface, and lens. As a result, automotive lamp design changes meant to circumvent these issues include those directed to lens modifications. Applied to the example of a striped appearance, selective masking of the lens surface may be employed in order to prevent a selected fraction of the emitted light from being transmitted, thus giving the appearance of striped light. While functional in certain instances, these strategies are often challenged by lighting inefficiencies, physical space restraints, and excess heat generation and retention. An ideal approach addresses these concerns while providing the aesthetic the user desires.

In an effort to address these concerns, light guides, as discussed above, have recently gained interest in vehicle lighting and/or signaling devices. Specifically, thick light guides have been employed in a number of applications as they are easily fabricated into a variety of shapes and are ideal for relatively simple features. However, when applied to complex lighting features, visual perception using thick light guides can be impacted by inefficiencies in internal light reflection and the position of light sources, leading to heterogeneities in light intensities and aesthetics across a lighting and/or signaling device.

In order to address the above-described concerns while delivering consumer-driven aesthetics, the present disclosure describes the implementation of light pipes for complex lighting features. Light pipes, a substantially cylindrical type of light guide, provide improved efficiency through enhanced control of internal reflections, homogenous lighting, and detail fidelity, while exploiting the minimal form factor and remote lighting characteristics of thick light guides. Exploiting these features, the present disclosure describes a light pipe arrangement for complex automotive lighting features.

With reference to FIG. 1, the present disclosure is generally related to automotive lighting. More specifically, FIG. 1 illustrates an automotive vehicle 100 with a rear lighting and/or signaling device 105. It can be appreciated that the lighting and/or signaling device 105 is merely representative and can be one of a variety of lighting and/or signaling devices of the car including, but not limited to, dipped-beam lamps, main-beam lamps, front fog lamps, cornering lamps, daytime running lamps, parking lamps, direction indicators, tail lamps, and stop lamps. In an example, the rear lighting and/or signaling device 105 is a traditional automotive lamp. In another example, the rear lighting and/or signaling device 105 is a light guide. In producing a similar visual effect to that accomplished by the traditional automotive lamp along a visual axis of an observer 106, a light source, remotely positioned from the output face of the light guide, delivers light rays to a series of reflecting facets, or decoupling regions, on a rear surface of the light guide, the rear surface being a surface hidden from an external observer. Light rays reflected from the reflecting facets may contact the opposing surface, or visible surface, with an angle of incidence such that the light ray is transmitted through the wall and into the ambient air. These transmitted light rays exit the light guide and become visible to the observer, creating an output face at a remote location from the true light source. Providing additional control, the reflecting facets may be designed such that the light rays exit the light guide at a predetermined angle. Preferably, the light rays exit the light guide at a pre-determined angle relative to a visual axis of an observer 106.

Figure 2:
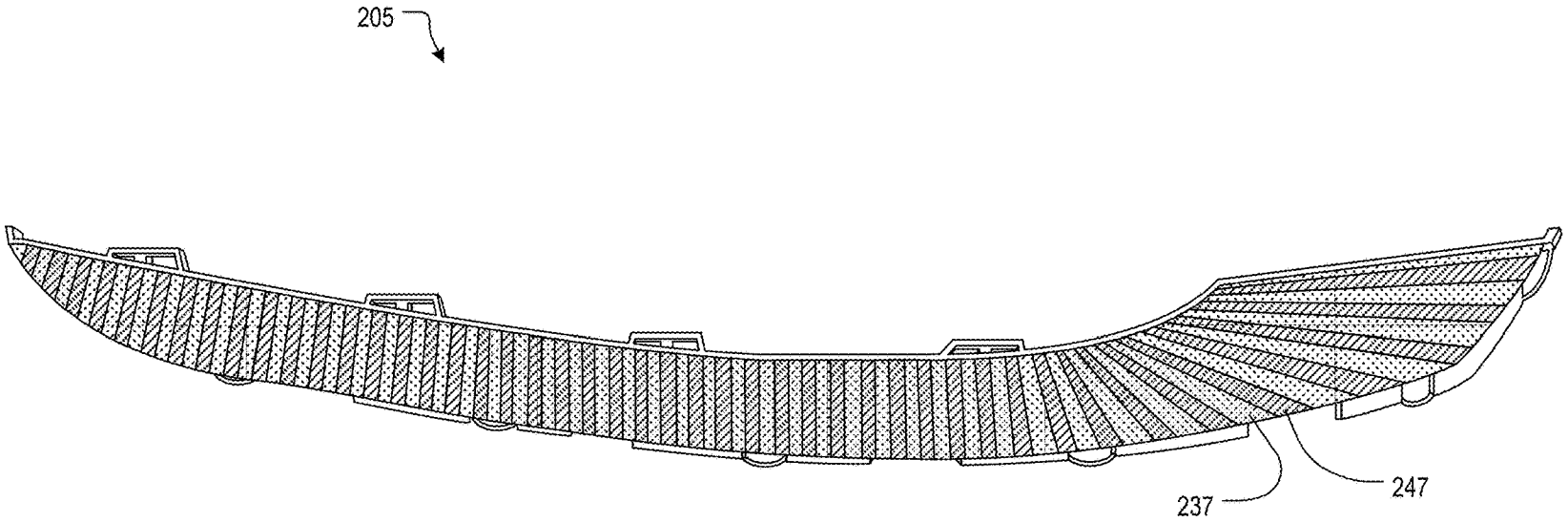
FIG. 2 is a cross-sectional view of a striped vehicle light, according to an exemplary embodiment of the present disclosure.

While effective in situations of simple lighting, such as the bulk lighting example provided in FIG. 1, when complex lighting arrangements are requested, the use of certain, thick light guides is not appropriate. FIG. 2 is a cross-sectional view of a striped vehicle light 205. This striped vehicle light 205, according to an exemplary embodiment of the present disclosure, is a complex lighting situation. The striped vehicle light 205 comprises alternating vertical stripes. In an embodiment, one vertical strip is an 'on' stripe 237 while the adjacent vertical stripe is an 'off' stripe 247. In other words, when the striped vehicle light 205 is illuminated, light should be transmitted through the 'on' stripe 237 to the user, and the 'off' stripe 247 should appear black. While a thick light guide offers the geometric flexibility in molding a vehicle light of the appropriate dimensions, light source location and the internal total reflection characteristics of the component make it likely that visual aesthetics will be negatively impacted. Specifically, the above complications result in heterogeneous lighting and the loss of light intensity from the input face of the light guide to the terminal face of the light guide, with intermediary output faces reflecting a gradient of light intensities. Achieving the desired aesthetic of FIG. 2, and similarly complex lighting devices, requires improving total internal reflection characteristics within the light guide and homogenous lighting, therefrom, thus ensuring adequate light intensity along the length of the light guide.

Figure 3A:
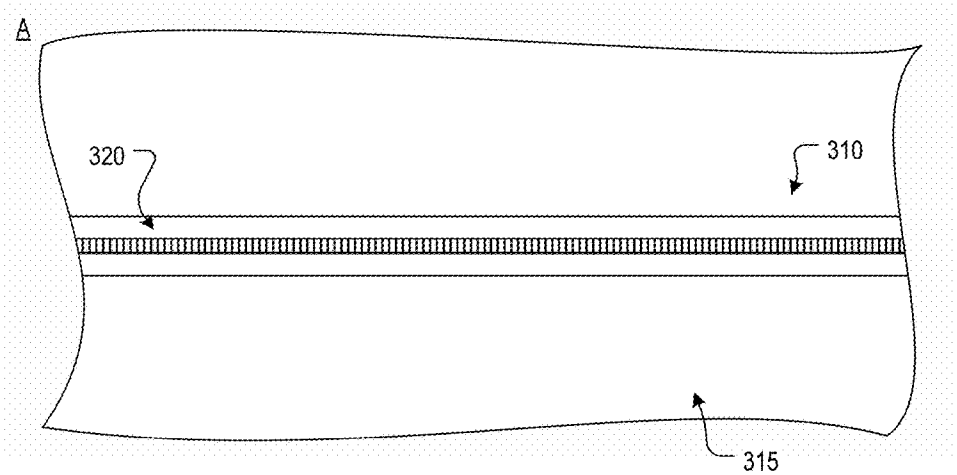
FIG. 3A is a perspective view of a light pipe, according to an exemplary embodiment of the present disclosure.
Figure 3B:
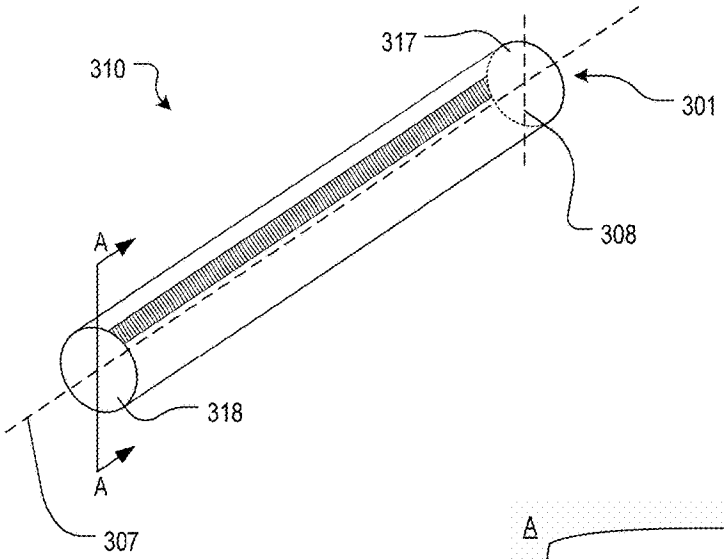
FIG. 3B is a cross-sectional view of a light pipe, according to an exemplary embodiment of the present disclosure.

To this end, and exploiting the remote lighting properties of light guides, a light pipe is proposed as a part of a solution. FIG. 3A is a perspective view of a light pipe 310, a substantially cylindrical type of light guide. A light source 301 is located adjacent to an input face 317 of the light pipe 310. The light source 301 may be one selected from a group including but not limited to a light-emitting diode, an incandescent lamp, a high-intensity discharge lamp, and a neon lamp tube. In an embodiment, a plurality of light sources 301 is employed. In an example, a first light source is positioned at the input face 317 of the light pipe 310 and a second light source is positioned at a terminal face 318 of the light pipe 310. The light pipe 310 has a radial axis 308 and a longitudinal axis 307. FIG. 3B is a cross-sectional view (AA) of the light pipe 310. The light pipe 310 is surrounded by an external environment. According to an embodiment, the external environment is ambient air 315. The light pipe 310 is comprised of a series of reflecting facets 320 that extend along the longitudinal axis of the light pipe 307. As light is generated at the light source 301, light rays propagate along the longitudinal axis 307 of the light pipe, being reflected by internal reflection faces of the light pipe 310. As the light rays propagate as far as the series of reflecting facets 320, a portion of the light rays are decoupled and reflected at an angle that causes them to contact an opposing reflection face with an angle of incidence such that the light rays exit the light pipe 310. In an embodiment, this results in the reflection face of the light pipe 310 becoming an output face, or 'apparent' light source.

According to an embodiment, in addition to the internal reflection faces of the light pipe 310, the terminal face 318 can be configured to reflect light rays back into the light pipe 310. This configuration, allowing for improved lighting efficiency, can be accomplished via techniques including but not limited to metallization.

In order to attain the aesthetic in FIG. 2, the light pipe 310 must be modified such that internal reflection of light rays does not ultimately create a single 'apparent' light source at the output face, as might be requested in a simple lighting device similar to FIG. 1.

Figure 4:
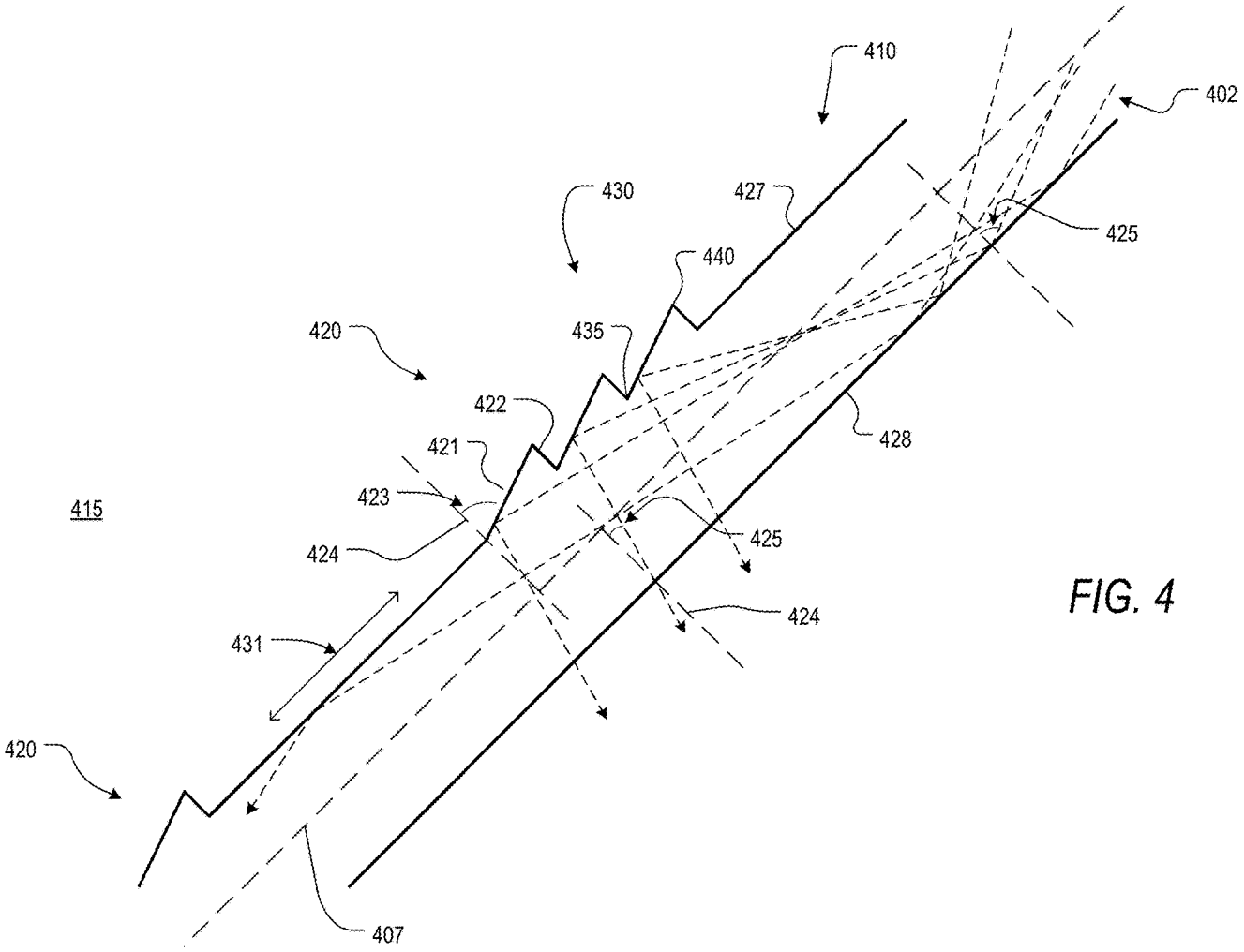
FIG. 4 is a cross-sectional view of a section of a light pipe, according to an exemplary embodiment of the present disclosure.

To this end, FIG. 4 is a cross-sectional view of a section of a light pipe 410. The light pipe 410 is surrounded by ambient air 415. According to an exemplary embodiment of the present disclosure, a series of reflecting facets 420 are positioned on a rear face of the light pipe 410 and are meant to decouple a portion of the light rays 402 that propagate through the light pipe 410. The series of reflecting facets 420 forms a grouping of reflecting facets 430. As a step towards achieving a striped appearance, and according to an exemplary embodiment, the continuous series of reflecting facets of FIG. 3 are segmented into a plurality of groupings of reflecting facets 430 and are separated by an inter-grouping distance 431. The inter-grouping distance 431 is pre-determined in accordance with a desired aesthetic. According to an embodiment, each of the plurality of groupings of reflecting facets 430 contains three reflecting facets 420. The number of reflecting facets 420 in each grouping of the present disclosure is merely representative and it should be appreciated that the number of reflecting facets 420 of each of the plurality of groupings of reflecting facets 430 is dependent on the desired aesthetic. The number of reflecting facets 420 of each of the plurality of groupings of reflecting facets 430 may further be dependent on the design of each facet (i.e., depth, width, length). Each reflecting facet 420 is comprised of an optically active face 421 and an optically passive face 422. The shape of the optically active face 421 and the shape of the optically passive face 422 may be of a shape appropriate for reflecting a light ray in a pre-determined manner. For example, the optically active face 421 may be of a planar shape while the optically passive face 422 may be of a convex shape, or vice versa. Alternatively, both faces may be of the same shape. According to an embodiment, the optically active face 421 and the optically passive face 422 are substantially rectangular.

According to an embodiment of the present disclosure, subsequent groupings of reflecting facets 430 of the light pipe 410 can be configured to reflect varying amounts of light rays in order to, for example, maintain a homogenous light output on an output face. In an embodiment, an angle formed between the normal axis 424 and the optically active face 421 can be modified with each subsequent grouping of reflecting facets 430 of the light pipe 410. In an example, the angle formed between the normal axis 424 and the optically active face 421 is decreased with each subsequent grouping of reflecting facets 430 of the light pipe, thus reflecting increasing fractions of light rays into an output face such that the light rays are projected onto the output face.

Moreover, in an example, each reflecting facet 420 can comprise of individual design features of the respective faces. Each reflecting facet 420 can be described in a cross-sectional view by a peak 440 and a valley 435, which establish an angular relationship between a plane of the optically active face 421 and a normal axis 424 that extends through the valley 435. This angular relationship is referred to as a vertex angle 423 and is pre-determined in accordance with the desired reflection of a light ray 402.

According to an exemplary embodiment of the present disclosure, a series of light rays 402 enter the light pipe 410 from an input face. In an embodiment, the light rays 402 are initially reflected by a refracting face 428. The refracting face 428 further defines a possible output face of the light pipe 410, the region at which a light ray 402 may contact the surface at an angle causing it to be refracted and exit the light pipe 410. For example, if the angle of incidence 425 is less than a pre-determined value, the light ray 402 will be refracted and leave the light pipe 410. Otherwise, total internal reflection will occur, the light ray 402 will be reflected back into the light pipe 410, and it will continue propagating in a direction substantially along a longitudinal axis 407.

This phenomena is due to a difference in refractive index between the light pipe 410 and the ambient air 415 that ensures the propagation of the light rays 402 along the length of the light pipe 410, by total internal reflection on one hand, and on the other hand, allows a portion of these light rays 402 to leave the light pipe 410 for lighting or other function.

According to an embodiment, the light pipe 410 is fabricated from polycarbonate and is surrounded by ambient air. According to Snell-Descartes law, the limiting angle of incidence at this boundary is approximately 39°, wherein the refractive index of polycarbonate is ~1.6 and the refractive index of air is ~1. While polycarbonate is employed in the present example, it should be appreciated that the light pipe 410 can be manufactured from a variety of materials including but not limited to polymethylmethacrylate (refractive index ~1.5).

With this understanding, it can be observed that, according to an embodiment, initially, the light ray 402 contacts the refracting face 428 at an angle of incidence 425 greater than 39° (in the case of polycarbonate). The light ray 402 is then reflected into one of the reflecting facets 420 of the plurality of groupings of reflecting facets 430. Coming into contact with the optically active face 421, a portion of the light rays 402 are again reflected back toward the refracting face 428 of the light pipe 410. In another embodiment, the light ray 402 contacts the reflecting face 427, wherein the light ray 402 may be similarly reflected or refracted. As the light ray 402 again contacts the refracting face 427 of the light pipe 410, this time at a steeper angle, it is determined that the angle of incidence 425 with respect to the normal axis 424 is less than the limiting angle of incidence (39° in the case of polycarbonate). As a result, the light ray 402 is refracted through the boundary and exits the light pipe 410.

According to an embodiment, a dimension of the optically passive face 422 is about 0.1 mm to 0.4 mm. An angle formed between the optically passive face 422 and a normal axis typically varies between 45° and 90° or between 45° and 315°, for example. The vertex angle 423 of the optically active face 421 with respect to the normal axis 424 may vary along the guide between, for example, 5° and 45°.

Figure 5:
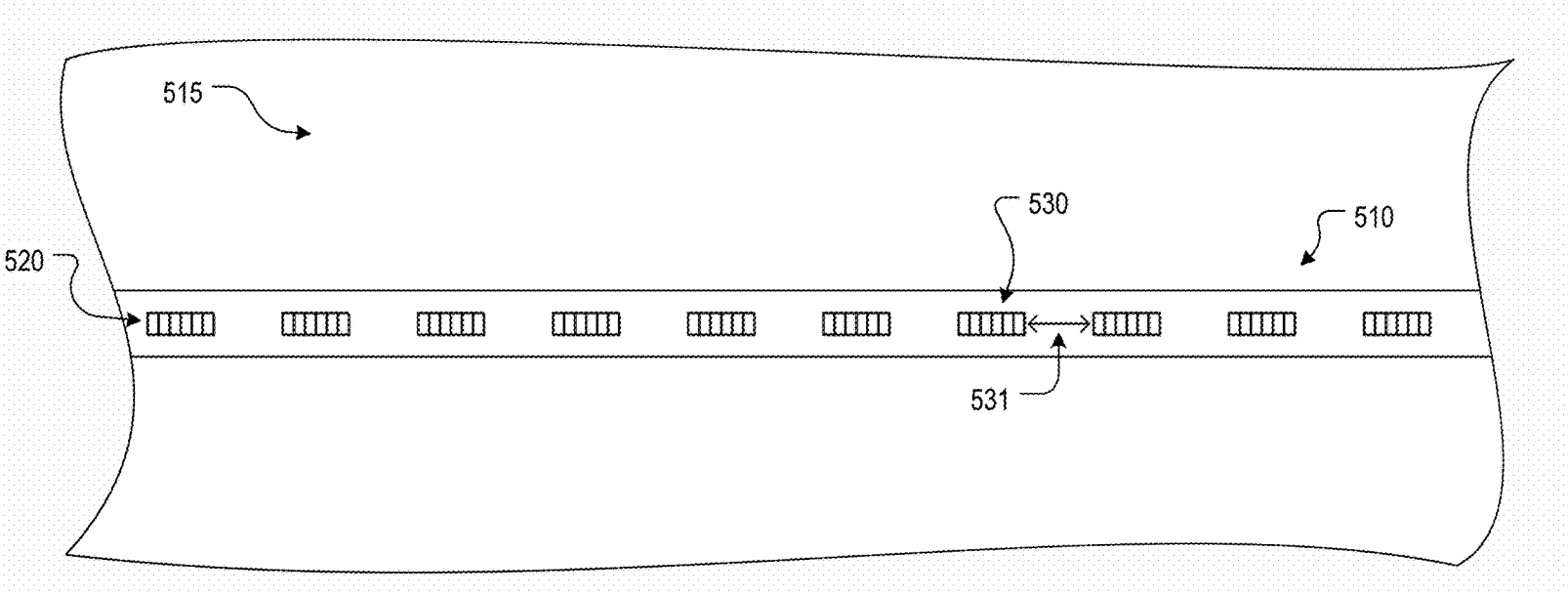
FIG. 5 is a cross-sectional view of a light pipe, according to an exemplary embodiment of the present disclosure.

FIG. 5 is a cross-sectional view of a light pipe. According to an exemplary embodiment of the present disclosure, the light pipe 510 is a substantially cylindrical light pipe comprising a plurality of groupings of reflecting facets 530 on a rear face of the light pipe 510. In an example, each of the plurality of groupings of reflecting facets 530 is comprised of one or more reflecting facets 520, with each of the plurality of groupings of reflecting facets 530 being separated from a subsequent grouping by an inter-grouping distance 531. The light pipe 510 is surrounded by ambient air 515. Each parameter of the light pipe 510 may be modified in accordance with a specified aesthetic. In order to create the striped aesthetic of FIG. 2, one or more light pipes 510 may be arranged tangentially, or proximate, as described, in part, in FIG. 6A, FIG. 6B, and FIG. 6C.

Figure 6C:
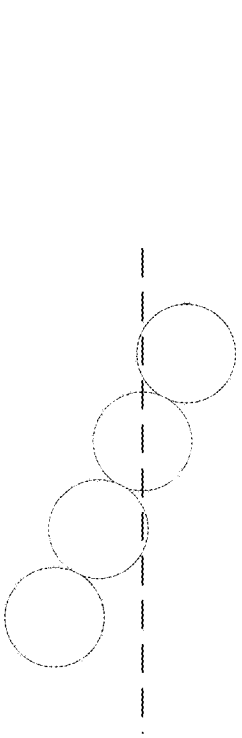
FIG. 6C is a cross-sectional representation of a plurality of light pipes in a stacked arrangement, according to an exemplary embodiment of the present disclosure.
Figure 6B:
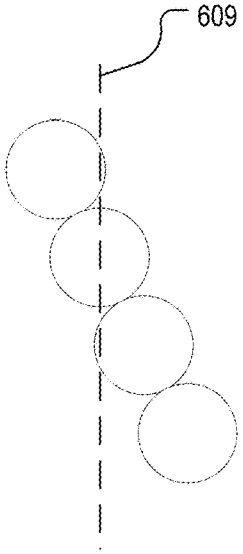
FIG. 6B is a cross-sectional representation of a plurality of light pipes in a stacked arrangement, according to an exemplary embodiment of the present disclosure.
Figure 6A:
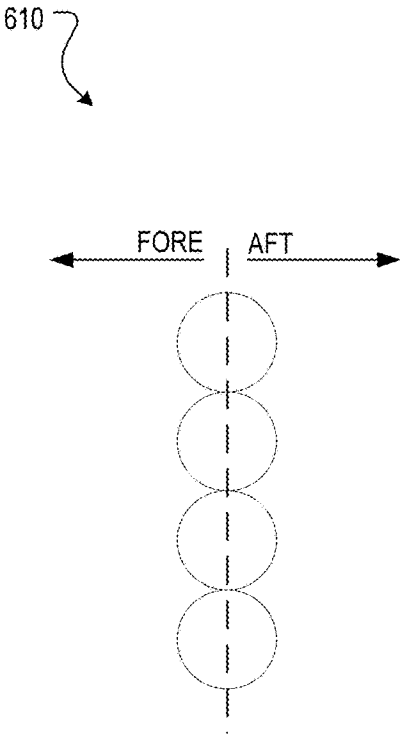
FIG. 6A is a cross-sectional representation of a plurality of light pipes in a stacked arrangement, according to an exemplary embodiment of the present disclosure.

In an example, each of the one or more light pipes may be arranged tangentially wherein there is an intersection of circumferences of successive light pipes. FIG. 6A, FIG. 6B, and FIG. 6C reflect a variety of possible arrangements of the one or more light pipes 610.

In FIG. 6A, in a standard configuration, each of the one more light pipes 610 are aligned, tangentially, along an axis 609. In an offset configuration, FIG. 6B depicts an arrangement of the one or more light pipes 610 such that the majority of the one or more light pipes 610 is arranged aft of the axis 609. Alternatively, FIG. 6C depicts an arrangement of the one or more light pipes 610 such that the majority of the one or more light pipes 610 is arranged fore of the axis 609. In an embodiment, the axis 609 is an axis perpendicular to a longitudinal axis of an automotive vehicle. The above-described light pipe 610 arrangements should be considered nonlimiting and merely reflective of exemplary aesthetic requests and the flexibility of the present disclosure.

Figure 6D:
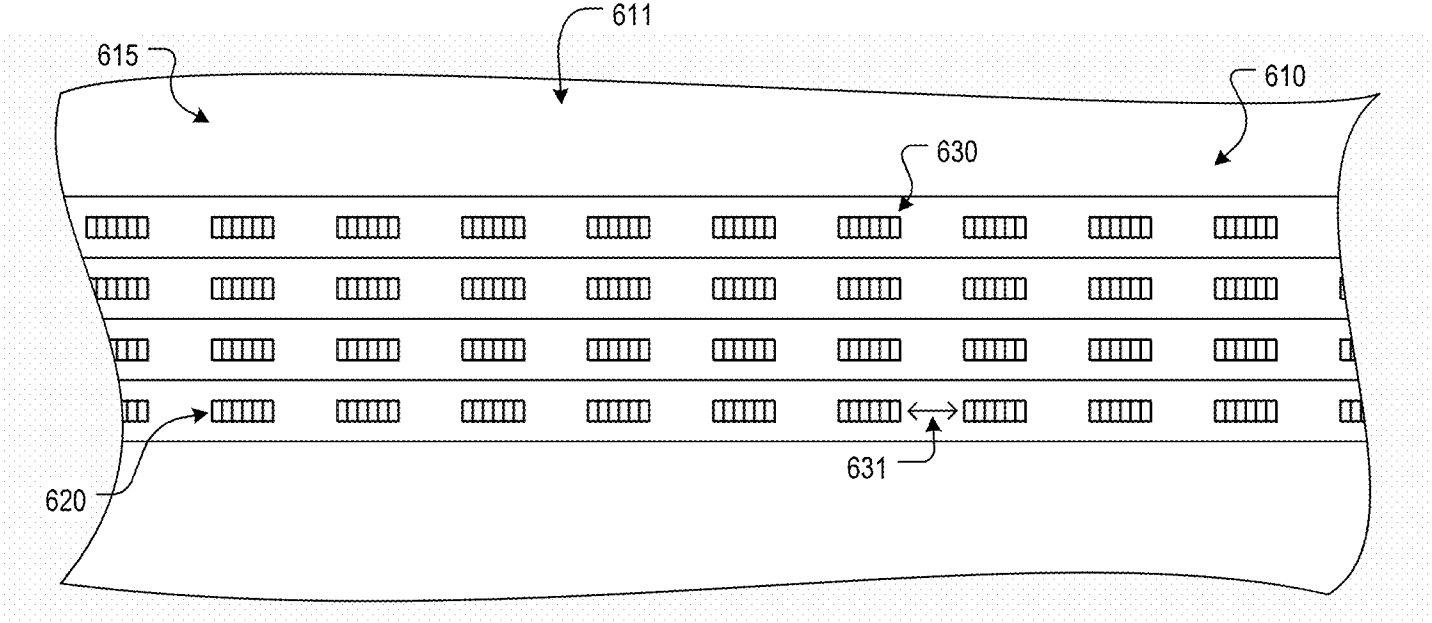
FIG. 6D is a representation of a stacked arrangement of a plurality of light pipes, according to an exemplary embodiment of the present disclosure.

FIG. 6D is a cross-sectional view of an arrangement of one or more light pipes 610 in a light pipe assembly 611, according to an exemplary embodiment of the present disclosure. The one or more light pipes 610 are proximately aligned along an axis perpendicular to a longitudinal axis of an automotive vehicle and extending through a radial axis of each light pipe 610. In an embodiment, the one or more light pipes 610 are tangential. Each of the one or more light pipes is comprised of a plurality of groupings of reflecting facets 630. Each of the plurality of groupings of reflecting facets 630 is comprised of one or more reflecting facets 620. In an example, the plurality of groupings of reflecting facets 630 is separated from a subsequent grouping of reflecting facets 630 by an inter-grouping distance 631. The inter-grouping distance 631 may be a constant, pre-determined value for each subsequent grouping of reflecting facets 630 or it may be a variable, pre-determined value between each subsequent grouping of reflecting facets 630, according to an aesthetic request. According to an embodiment of the present disclosure, each of the plurality of groupings of reflecting facets 630 is separated by a constant, pre-determined inter-grouping distance 631.

According to an embodiment of the present disclosure, each of the one or more light pipes 610 of the light pipe assembly 611 are fabricated from a material selected from a group including but not limited to polycarbonate, polymethylmethacrylate, and polyimides. In an example, the light pipe assembly 611 is surrounded by ambient air 615.

The cross-sectional view of the light pipe assembly 611 of FIG. 6D provides a view from the perspective of the observer. While each of the plurality of groupings of reflecting facets 630 is aligned according to an embodiment of the present disclosure, it should be appreciated that each of the plurality of groupings of reflecting facets 630 of each light pipe 610 can be offset from each of the plurality of groupings of reflecting facets 630 of an adjacent, or proximate, light pipe 610, with respect to an axis perpendicular to the longitudinal axis of the automotive vehicle. Moreover, each of the one or more light pipes 610 of the light pipe assembly 611 may comprise a unique number of groupings of reflecting facets 630. In an example, a light pipe assembly 611 is comprised of four light pipes 610. A first light pipe is comprised of six groupings of reflecting facets 630, a second light pipe is comprised of four groupings of reflecting facets 630, a third light pipe is comprised of four groupings of reflecting facets 630, and a fourth light pipe is comprised of six groupings of reflecting facets 630. Each of the plurality of groupings of reflecting facets 630 can be arranged on each light pipe, through modifications including but not limited to the inter-grouping distance and number of reflecting facets, such that a 'turn arrow' indicator is visualized by the observer when the light source is activated.

According to an embodiment of the present disclosure, each of the one or more light pipes 610 of the light pipe assembly 611 is substantially linear. It should be appreciated that the longitudinal shape of each of the one or more light pipes 610 may also be curved. According to an embodiment of the present disclosure, each of the one or more light pipes 610 of the light pipe assembly 611 is of a diameter substantially similar to adjacent light pipes 610. It should be appreciated that each light pipe 610, and reflecting facet 620 therein, may be of different dimensions according to aesthetic requests. Moreover, the diameter of each of the one or more light pipes 610 of the light pipe assembly 611 may differ along the longitudinal axis of the pipe or may be constant, in order to obtain a desired aesthetic.

Figure 7:
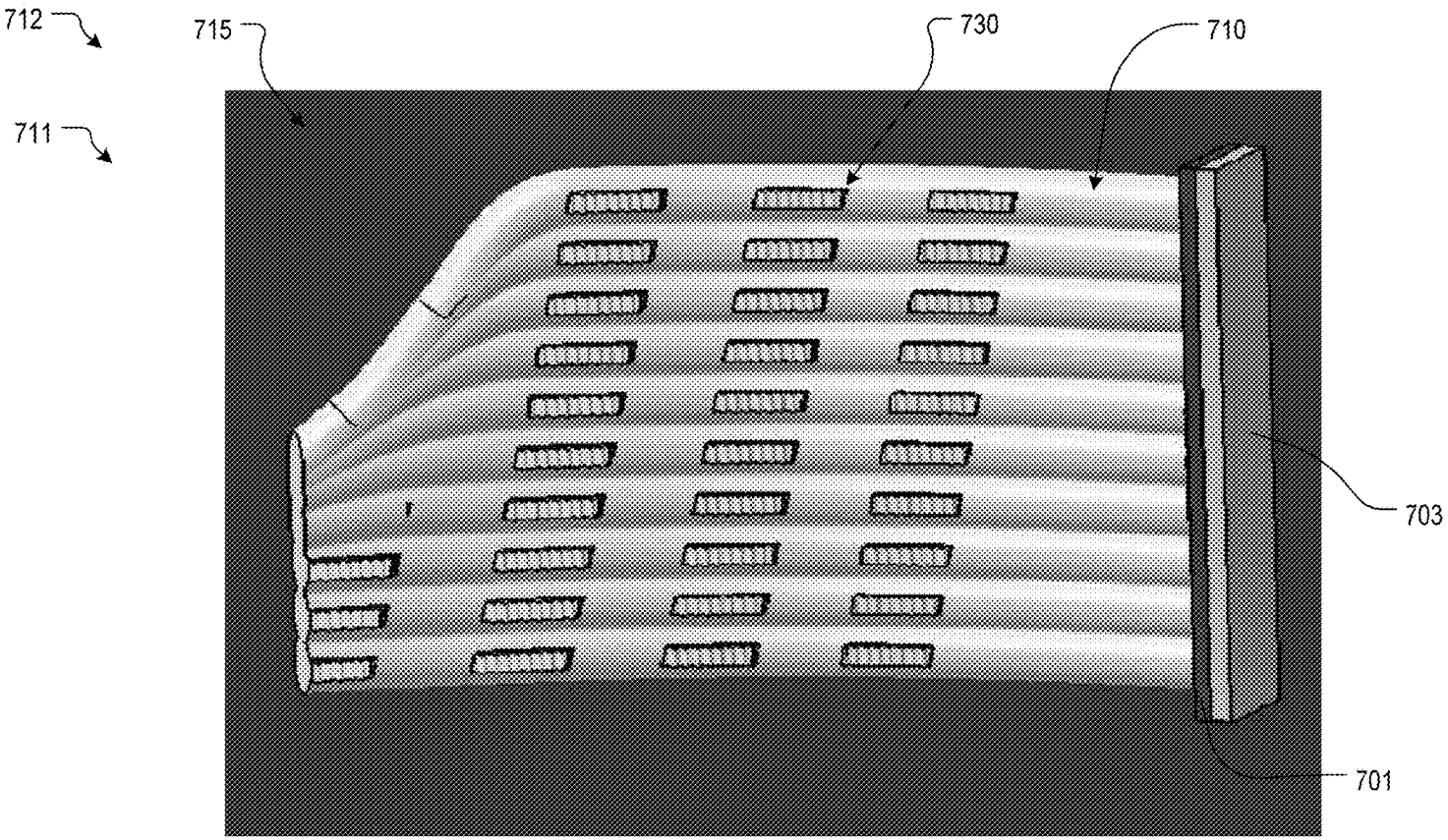
FIG. 7 is an illustration of a stacked arrangement of a plurality of light pipes, according to an exemplary embodiment of the present disclosure.

FIG. 7 is an in silico proof of concept model of a light pipe assembly 712, according to an exemplary embodiment of the present disclosure. The light pipe assembly 712 includes a light pipe assembly 711 optically-coupled to a light source 701. The light pipe assembly 712 is surrounded by ambient air 715. The light source 701 is electrically-coupled to a printed circuit board (PCB) 703. The light pipe assembly 711 is comprised of one or more light pipes 710 arranged such that a radial axis of each of the one or more light pipes 710 is aligned with an axis that is perpendicular to a longitudinal axis of an automotive vehicle. In an embodiment, a single light source 701, optically-coupled to an optical splitter, provides light to an input face of the one or more light pipes 710. In an exemplary embodiment, the light source 701 comprises a plurality of light sources corresponding to each of the one or more light pipes 710. Each of the one or more light pipes is fabricated from polycarbonate. In another example, each of the one or more light pipes is fabricated from a material selected from a group including but not limited to normal grade and optical grade materials. Further, and according to an embodiment, each of the one or more light pipes can be fabricated from a material selected with respect to anticipated environmental conditions including but not limited to heat exposure, bending, and vibration.

According to an embodiment, each of the one or more light pipes 710 is proximate to a subsequent light pipe 710, each subsequent light pipe being stacked vertically. Each of the one or more light pipes 710 is comprised of a plurality of groupings of reflecting facets 730. According to an embodiment, each of the plurality of groupings of reflecting facets 730 is offset from a corresponding grouping of reflecting facets 730 of an adjacent light pipe 710, as observed in FIG. 7, and relative to the axis perpendicular to the longitudinal axis of the automotive vehicle. Each grouping of reflecting facets 730 is separated from a subsequent grouping of reflecting facets 730 by a pre-determined inter-grouping distance. The number of reflecting facets comprising each grouping of reflecting facets 730 is determined in accordance with the desired aesthetic. Further, each subsequent grouping of reflecting facets 730 is configured to increase the fraction of light reflected by the grouping of reflecting facets such that a homogenously lit output face is perceived.

Figure 8:
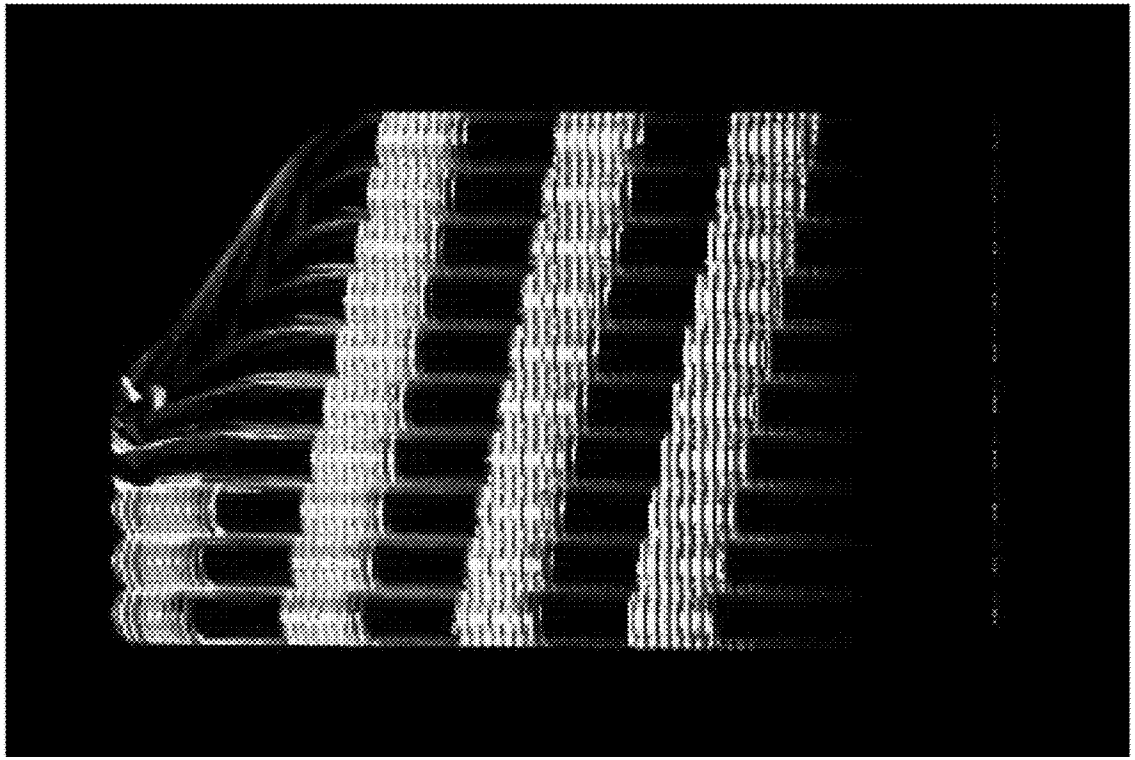
FIG. 8 is an in silico simulation of a plurality of light pipes, according to an exemplary embodiment of the present disclosure.

FIG. 8 is an in silico simulation of a light pipe assembly 812, in accordance with the model of FIG. 7. From the simulation, it can be observed that each of the plurality of groupings of reflecting facets of each light pipe produces a precise lighting feature on an apparent output face of the light pipe. Moreover, light intensity is consistent from the light source to the terminal face, resulting in a homogenous lighting output. In this way, the vertically stacked light pipes appear to create a continuously lit, or 'on', region, adjacent to a dark, or 'off', region. The result is a striped appearance resembling the aesthetic request of FIG. 2. With this light pipe-based approach, it is possible to produce homogenous, complex lighting features while exploiting the geometric benefits of optical guides.

Figure 9:
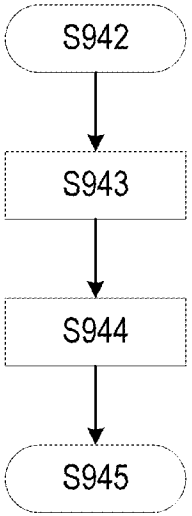
FIG. 9 is a flowchart of a method of guiding light in a lighting device, according to an exemplary embodiment of the present disclosure.

FIG. 9 is a flowchart of a method of guiding light in a lighting device, according to an exemplary embodiment of the present disclosure. First, light rays emitted from a light source enter a light guide via an input face, the light source being optically-coupled to the light guide S942. Next, the light rays are guided, or propagated, along a light guiding direction via total internal reflection S943. Upon contact with one of a plurality of decoupling regions, a fraction of the emitted light is reflected towards a reflecting face of the light guide S944. Due to the angle of incidence of the reflected fraction of emitted light, the reflected light is projected onto the reflecting face of the light guide, the reflecting face of the light guide becoming an output face S945.

Embodiments of the present disclosure may also be as set forth in the following parentheticals.

(1) A lighting device for an automotive vehicle, comprising at least one light source, and one or more light guides optically-coupled to the at least one light source and configured to guide a light emitted from the at least one light source along a light guiding direction, wherein each of the one or more light guides extend in a pre-determined direction from the at least one light source and comprise a plurality of decoupling regions separated from each other by an inter-grouping distance along the light guiding direction of the one or more light guides.

(2) The lighting device according to (1), wherein the plurality of decoupling regions are disposed on a rear face of the one or more light guides, the plurality of decoupling regions being configured to project light from the one or more light guides to an output face.

(3) The lighting device according to either (1) or (2), wherein each of the plurality of decoupling regions comprise a grouping of reflecting facets, each reflecting facet of said grouping of reflecting facets being prismatic.

(4) The lighting device according to any of (1) to (3), wherein the inter-grouping distance is pre-determined such that the inter-grouping distance between sequential regions of the plurality of decoupling regions is similar, dissimilar, or a combination thereof.

(5) The lighting device according to any of (1) to (4), wherein the grouping of reflecting facets of an initial one of the plurality of decoupling regions is configured to reflect a fraction of the guided light emitted from the at least one light source, each of subsequent ones of the plurality of decoupling regions being configured to reflect an increasing fraction of guided light emitted from the at least one light source.

(6) The lighting device according to any of (1) to (5), wherein the at least one light source is a light-emitting diode.

(7) The lighting device according to any of (1) to (6), wherein the at least one light guide is polycarbonate.

(8) The lighting device according to any of (1) to (7), wherein a subsequent one of the one or more light guides is proximately arranged to an initial one of the one or more light guides.

(9) The lighting device according to any of (1) to (8), wherein each subsequent one of the one of the one or more light guides is proximately arranged relative to an axis perpendicular to a longitudinal axis of the automotive vehicle.

(10) The lighting device according to any of (1) to (9), wherein each of the plurality of decoupling regions of the subsequent one of the one or more light guides is arranged based upon a position of each of the plurality of decoupling regions of the initial one of the one or more light guides, said plurality of decoupling regions being arranged in order to produce an aesthetic.

(11) A method of guiding light in a lighting device of an automotive vehicle, comprising guiding, along a light guiding direction from an input face of one of one or more light guides, a light emitted from at least one light source, reflecting, via one of a plurality of decoupling regions, the light emitted from the at least one light source, and projecting, via the one of the plurality of decoupling regions, the reflected light to an output face of the one of the one or more light guides, wherein each of the one or more light guides are optically-coupled to the at least one light source and extends in a pre-determined direction from the at least one light source, and the plurality of decoupling regions are separated from one another by an inter-grouping distance along the light guiding direction of each of the one or more light guides.

(12) The method according to (11), wherein the plurality of decoupling regions are disposed on a rear face of the one or more light guides, the plurality of decoupling regions being configured to project light from the one or more light guides to an output face.

(13) The method according to either (11) or (12), wherein each of the plurality of decoupling regions comprise a grouping of reflecting facets, each reflecting facet of said grouping of reflecting facets being prismatic.

(14) The method according to any of (11) to (13), wherein the inter-grouping distance is pre-determined such that the inter-grouping distance between sequential regions of the plurality of decoupling regions is similar, dissimilar, or a combination thereof.

(15) The method according to any of (11) to (14), wherein the grouping of reflecting facets of an initial one of the plurality of decoupling regions is configured to reflect a fraction of the guided light emitted from the at least one light source, each of subsequent ones of the plurality of decoupling regions being configured to reflect an increasing fraction of guided light emitted from the at least one light source.

(16) The method according to any of (11) to (15), wherein the at least one light source is a light-emitting diode.

(17) The method according to any of (11) to (16), wherein the at least one light guide is polycarbonate.

(18) The method according to any of (11) to (17), wherein a subsequent one of the one or more light guides is proximately arranged to an initial one of the one or more light guides.

(19) The method according to any of (11) to (18), wherein each subsequent one of the one of the one or more light guides is proximately arranged relative to an axis perpendicular to a longitudinal axis of the automotive vehicle.

(20) The method according to any of (11) to (19), wherein each of the plurality of decoupling regions of the subsequent one of the one or more light guides is arranged based upon a position of each of the plurality of decoupling regions of the initial one of the one or more light guides, said plurality of decoupling regions being arranged in order to produce an aesthetic.

Obviously, numerous modifications and variations are possible in light of the above teachings. It is therefore to be understood that within the scope of the appended claims, the invention may be practiced otherwise than as specifically described herein.

Thus, the foregoing discussion discloses and describes merely exemplary embodiments of the present invention. As will be understood by those skilled in the art, the present invention may be embodied in other specific forms without departing from the spirit or essential characteristics thereof. Accordingly, the disclosure of the present invention is intended to be illustrative, but not limiting of the scope of the invention, as well as other claims. The disclosure, including any readily discernible variants of the teachings herein, defines, in part, the scope of the foregoing claim terminology such that no inventive subject matter is dedicated to the public.

The invention claimed is:

1. A lighting device for an automotive vehicle, comprising:

a plurality of light sources; and a plurality of light guides optically-coupled to the plurality of light sources and configured to guide a light emitted from the plurality of light sources along a light guiding direction, wherein each one of the plurality of light guides extends in a pre-determined direction from a corresponding one of the plurality of light sources and includes a plurality of decoupling regions separated from each other by an inter-grouping region defined by an inter-grouping distance along the light guiding direction of each one of the plurality of light guides, wherein the plurality of light guides are arranged in contact, a second one of the plurality of light guides being stacked on a first one of the plurality of light guides, each decoupling region of the plurality of decoupling regions of each one of the plurality of light guides is aligned with a corresponding decoupling region of the plurality of decoupling regions of an adjacent light guide of the plurality of light guides, and when illuminated, the aligned decoupling regions produce a lit visual effect along a common axis of the plurality of light guides, inter-grouping regions therebetween being unlit.

2. The lighting device according to claim 1, wherein the plurality of decoupling regions are disposed on a rear face of each one of the plurality of light guides, the plurality of decoupling regions being configured to reflect light from the rear face of each one of the plurality of light guides to an output face, the reflected light being refracted along a visual axis by the output face.

3. The lighting device according to claim 1, wherein each of the plurality of decoupling regions includes a grouping of reflecting facets, each reflecting facet of said grouping of reflecting facets being prismatic.

4. The lighting device according to claim 1, wherein the inter-grouping distance defining the inter-grouping region is pre-determined such that the inter-grouping distance between sequential decoupling regions of the plurality of decoupling regions is similar, dissimilar, or a combination thereof.

5. The lighting device according to claim 1, wherein an initial one of the plurality of decoupling regions of each one of the plurality of light guides is configured to reflect a fraction of the guided light emitted from the corresponding one of the plurality of light sources, each subsequent one of the plurality of decoupling regions of each one of the plurality of light guides being configured to reflect an increasing fraction of guided light emitted from the corresponding one of the plurality of light sources.

6. The lighting device according to claim 1, wherein each one of the plurality of light sources is a light-emitting diode.

7. The lighting device according to claim 1, wherein each one of the plurality of light guides is polycarbonate.

8. The lighting device according to claim 1, wherein the common axis of the plurality of light guides is an axis perpendicular to a longitudinal axis of the vehicle.

9. The lighting device according to claim 8, wherein the common axis of the plurality of light guides intersects a center of each one of the plurality of light guides.

10. The lighting device according to claim 1, wherein the lit visual effect is a striped aesthetic, each stripe of the striped aesthetic being aligned with the common axis of the plurality of light guides and alternating with an unlit inter-grouping region.

11. A method of guiding light in a lighting device of an automotive vehicle, comprising:

guiding, along a light guiding direction from an input face of each one of a plurality of light guides, a light emitted from a corresponding one of a plurality of light sources;

reflecting, via a plurality of decoupling regions of each one of the plurality of light guides, the light emitted from the corresponding one of the plurality of light sources; and refracting, via an output face of each of the plurality of light guides, the reflected light, the refracted light being refracted along a visual axis, wherein each one of the plurality of light guides is optically-coupled to the corresponding one of the plurality of light sources and extends in a pre-determined direction from the corresponding one of the plurality of light sources, the plurality of decoupling regions are separated from one another by an inter-grouping region defined by inter-grouping distance along the light guiding direction of each one of the plurality of light guides, the plurality of light guides are arranged in contact, a second one of the plurality of light guides being stacked on a first one of the plurality of light guides, each decoupling region of the plurality of decoupling regions of each one of the plurality of light guides is aligned with a corresponding decoupling region of the plurality of decoupling regions of an adjacent light guide of the plurality of light guides, and when illuminated, the aligned decoupling regions produce a lit visual effect along a common axis of the plurality of light guides, inter-grouping regions therebetween being unlit.

12. The method according to claim 11, wherein the plurality of decoupling regions are disposed on a rear face of each one of the plurality of light guides, the plurality of decoupling regions being configured to reflect light from the rear face of each one of the plurality of light guides to a corresponding output face.

13. The method according to claim 11, wherein each of the plurality of decoupling regions includes a grouping of reflecting facets, each reflecting facet of said grouping of reflecting facets being prismatic.

14. The method according to claim 11, wherein the inter-grouping distance defining the inter-grouping region is pre-determined such that the inter-grouping distance between sequential decoupling regions of the plurality of decoupling regions is similar, dissimilar, or a combination thereof.

15. The method according to claim 11, wherein an initial one of the plurality of decoupling regions of each one of the plurality of light guides is configured to reflect a fraction of the guided light emitted from the corresponding one of the plurality of light sources, each subsequent one of the plurality of decoupling regions of each one of the plurality of light guides being configured to reflect an increasing fraction of guided light emitted from the corresponding one of the plurality of light sources.

16. The method according to claim 11, wherein each one of the plurality of light sources is a light-emitting diode.

17. The method according to claim 11, wherein each one of the plurality of light guides is polycarbonate.

18. The method according to claim 11, wherein the lit visual effect is a striped aesthetic, each stripe of the striped aesthetic being aligned with the common axis of each one of the plurality of light guides and alternating with an unlit inter-grouping region.

19. The method according to claim 11, wherein the common axis of the plurality of light guides is an axis perpendicular to a longitudinal axis of the vehicle.

20. The method according to claim 19, wherein the common axis of the plurality of light guides intersects a center of each one of the plurality of light guides.

* * * * *